United States Patent [19]

Childress

[11] 4,076,337

[45] Feb. 28, 1978

[54] DRILL STEEL HOLDER

[76] Inventor: Ray Childress, P.O. Box 86, Richlands, Va. 24641

[21] Appl. No.: 725,649

[22] Filed: Sep. 22, 1976

[51] Int. Cl.[2] ..... F16C 31/00

[52] U.S. Cl. ..... 308/3.9; 81/57.2; 173/164; 175/220

[58] Field of Search ..... 308/3.9; 24/263 D, 263 DA; 81/57.2, 57.34; 175/220; 173/163, 164; 279/1 L

[56] References Cited

U.S. PATENT DOCUMENTS

| | | | |
|---|---|---|---|
| 2,781,185 | 2/1957 | Robbins | 175/220 |
| 3,749,454 | 7/1973 | Bailey et al. | 308/3.9 |
| 3,892,148 | 7/1975 | Wiley | 81/57.2 |
| 3,906,820 | 9/1975 | Hauk | 81/57.34 |

*Primary Examiner*—Trygve M. Blix
*Assistant Examiner*—Charles E. Frankfort
*Attorney, Agent, or Firm*—Littlepage, Quaintance, Murphy, Richardson & Webner

[57] ABSTRACT

A drill steel holder is mounted on the drill box of a mine roof drilling and bolting machine. An opposed pair of levers are supported intermediate outboard and inboard ends thereof by vertical pivots. A hydraulic ram connected between the outboard ends of the lever swings their inboard ends thereof towards and away from one another. Rollers on chassis pivoted onto the inboard ends embrace a drill steel mounted in a chuck in the drill box, and stops are provided for limiting the pivotal movement of one of the levers.

5 Claims, 5 Drawing Figures

FIG. 1
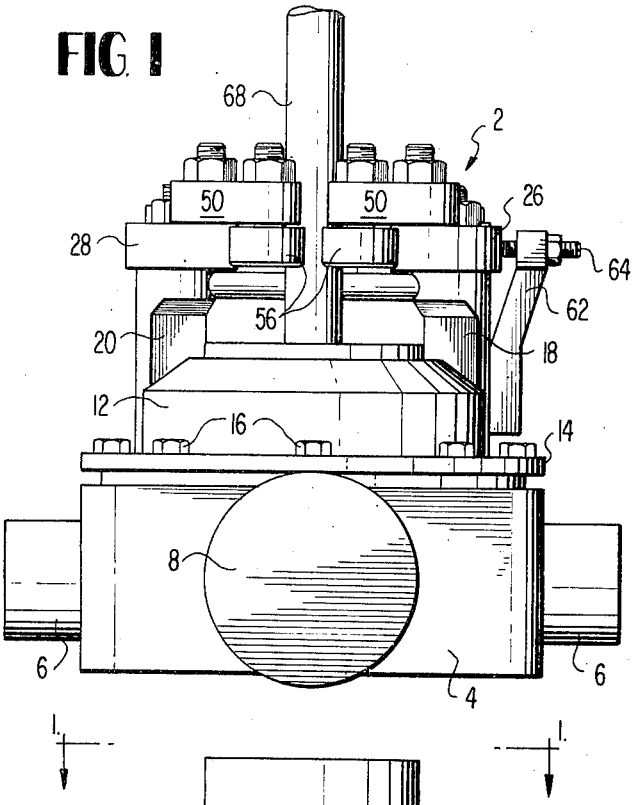
FIG. 2
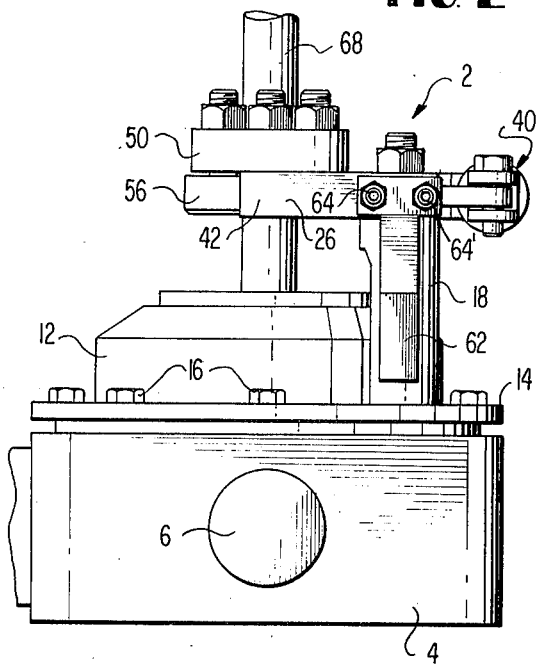
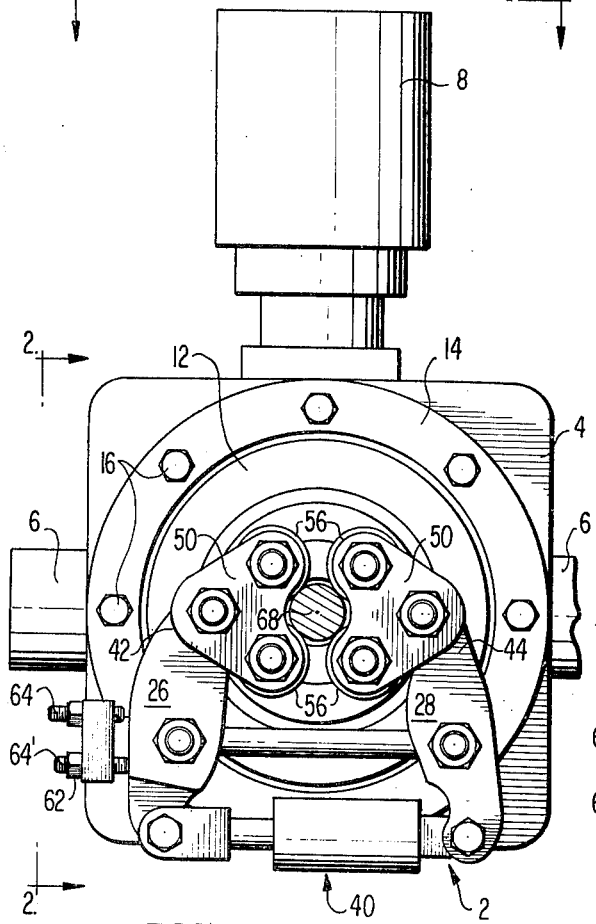
FIG. 3
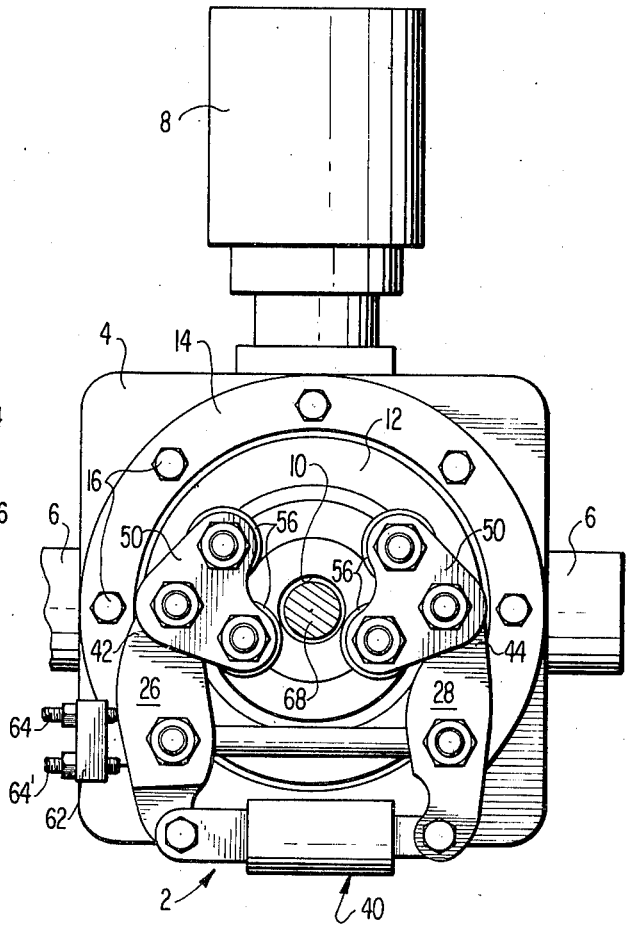
FIG. 4

DRILL STEEL HOLDER

FIELD OF INVENTION

Machine Elements, Bearings And Guides, Guide or Slide, Having relatively mobile parts for lateral insertion and retention of guided element.

PRIOR ART

O'Neill et al U.S. Pat. No. 3,246,547 and Bucelluni U.S. Pat. No. 3,756,669.

BACKGROUND AND OBJECTS

In a typical mine roof drilling and bolting machine there is a boom having a drill box on its free end. The machine operator is situated at a control station at one side of the boom. When a roof bolt is to be inserted, the steel of a roof drill is inserted into a chuck in the drill box and the bolt hole is drilled. Then the drill is removed and the shank of a bolt wrench is inserted into the chuck and the roof bolt is wrenched into place. Usually the drill steel and bolt wrench have an annular flange extending outwardly from near the lower end thereof, which flange rests upon the top of the chuck.

From time to time, mechanisms have been provided for centering the drill steels and some of them (O'Neill et al and Bucelluni) have been power-operated by hydraulic rams. However, in neither of these devices are there antifriction members for engaging the drill steel and, taking into account the forces at play and the abrasive nature of the environmental dust, wear of the drill steel and the centering members which engage them is a problem. One object of this invention is to provide centering arms carrying rollers which engage the drill steel to reduce wear on them and the drill steel and to reduce the power required to drive the steel.

Another problem with the prior art centering devices is that they do not accommodate themselves to even slight angular distortions of the drill steel when the latter is inserted into the chuck. Accordingly, another object of this invention is to mount each of two pairs of drill steel engaging rollers at two corners of a triangular chassis plate which is pivoted at its other corner to the inboard end of a lever arm so that the rollers embrace the steel in an accommodating manner.

Because the machine operator is situated at one side of the drill box, it is difficult for him to see the action of the rollers on the far side of the centering device. They should have ample swinging motions to accommodate themselves to the work, but it is undesirable for these rollers to be too far away from the steel when the rollers are swung out to a dis-engaging funtion, and they should not be too close in when the steel is engaged. To meet these needs, means are provided for limiting the outward and inward swinging movements of one of the roller chassis supporting lever arms.

These and other objects will be apparent from the following specifications and drawings, in which:

FIG. 1 is an end elevation of a drill box with the drill steel holder assembled thereon;

FIG. 2 is a side elevation of the assembly shown in FIG. 1;

FIG. 3 is a top plan view of the assembly, showing the steel holders in steel-embracing position;

FIG. 4 is a view similar to FIG. 3, but showing the drill steel holders in steel-releasing position; and, FIG. 5 is an exploded view of the assembly.

In referring now to the drawings, in which like reference numerals denote similar elements, the essentials of the apparatus will first be described in connection with FIGS. 1-4 and mechanical details will be further described in connection with FIG. 5.

Figure 5:
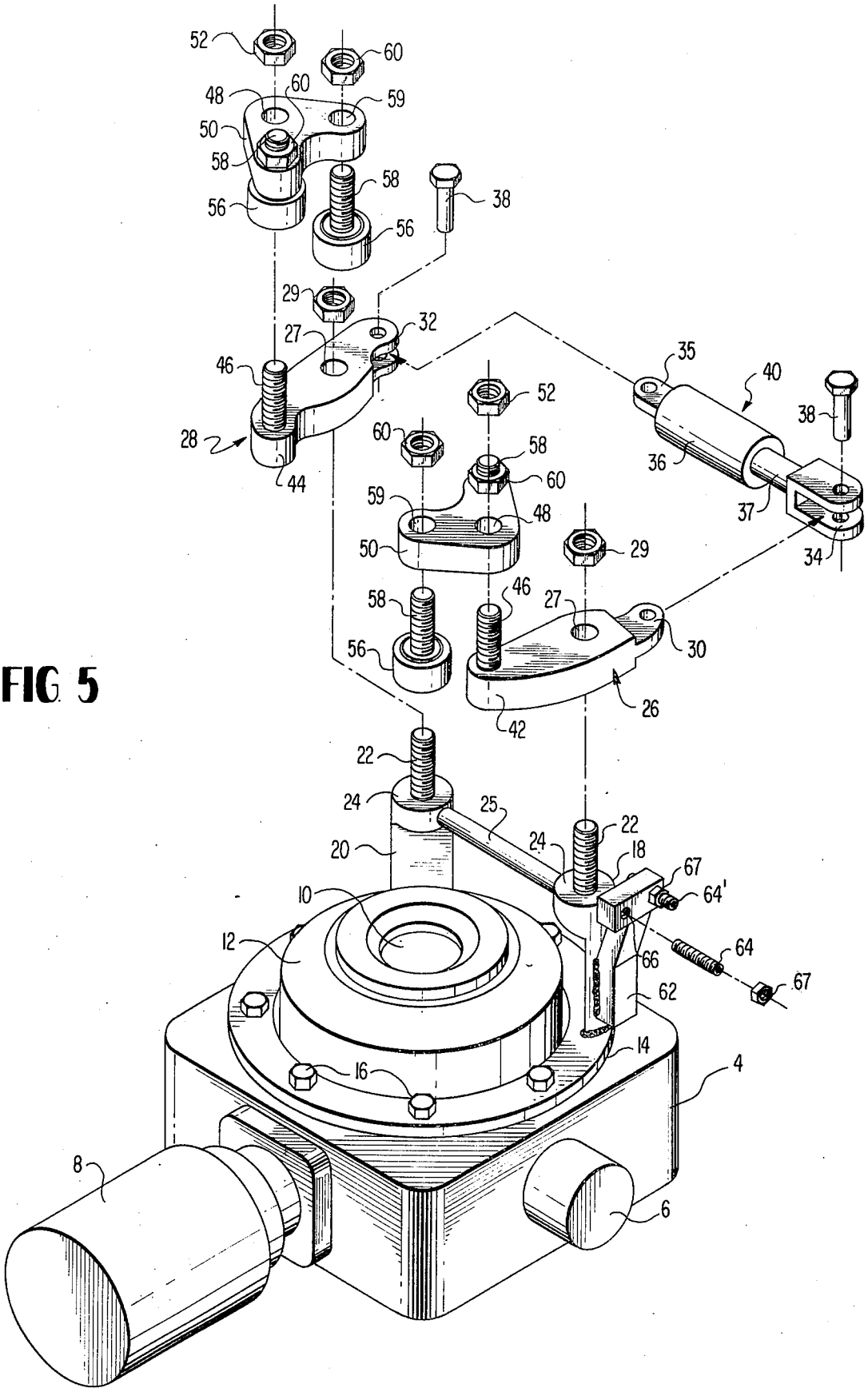

The centering device 2 is mounted on the drill box 4 which is supported by trunion pins 6 on the boom (not shown) of a mine roof drilling and bolting machine. Linkage (not shown) maintain the drill box upright. A motor 8 drives a chuck socket 10 centrally disposed in an upstanding boss 12 on the upper side of the drill box. The elements thus far described are conventional and well known in the art. The centering device 2 is supported on a ring 14 which surrounds boss 12 and is mounted by bolts 16 on the top of the drill box 4. Extending upwardly from ring 14 are a pair of posts 18 and 20 on the top of which are pivoted levers 26 and 28 of the first class. Between the outboard ends of the levers is mounted a hydraulic ram 40 which, when extended or retracted, swings inboard ends 42 and 44 of the levers toward or away from the axis of rotation of the drill steel. Pivoted to the inboard ends of the levers are triangular chassis plates 50 which carry, on two of their corners, rollers 56. When ram 40 is retracted (FIG. 4) the triangular chassis plates 50 are spread apart so that a drill steel 68 can be inserted into chuck socket 10, and when ram 40 is extended (FIG. 3) the chassis plates 50 swing inwardly until rollers 56 embrace and bracket the drill steel 68. An arm 62 affixed to post 18 supports a pair of set screws 64, 64' which bracket the pivotal axis of lever 26. The setting of set screw 64 determines the outer limit to which the inboard end 42 of lever 26 may swing, and the setting of set screw 64' determines the inner limit to which the inboard end 42 of lever 26 may swing.

Referring to the details shown in FIG. 5, the upstanding posts 18 and 20 have studs 22 which extend upwardly from flat upper surfaces 24 of the post. A cross brace 25 rigidifies the posts. The undersides of levers 26, 28 rest upon the flat upper post surfaces 24 and the studs 22 extend through bores 27 in the levers and the latter are held down by nuts 29. The outboard end of lever 26 is provided with a flat tab 30 and the outboard end of lever 28 has a clevice 32. Flat tab 30 engages in a clevice 34 on the piston 37 of ram 40 and the flat tab end 35 on the ram cylinder 36 engages in clevice 32 on lever 28, the tabs and clevices being pivotally secured together by pins 38.

On the inboard ends 42 and 44 of levers 26 and 28 are upstanding studs 46 over which are engaged through holes 48 at corresponding corners of triangular chassis plates 50, the latter being held down onto the inboard ends of the levers by nuts 52. Rollers 56 are supported by bolts 58 which engage through holes 59 at the other corners of the triangular chassis plates 50, the chassis plates 50 being fastened down by nuts 60. While they are not disclosed in the drawings, it should be understood that conventional bearing sleeves for the studs and washers for the nuts may be used in order to reduce wear and assure the free pivotal movements of the levers 26 and 28 about the supporting studs 22, and the free pivotal movements of the triangular chassis plates about their supporting studs 46. Nuts 67 are used in the conventional manner to retain the set screw 64, which engage through threaded screw hole 66 in arm 62.

In describing the operation, it will be assumed that the machine operator is at an operating station which is off to the right of the drill box 4 as seen in FIG. 4, and that the set screws 64 and 64' will have been set to control the swinging of lever 26 to its desired limits. Ram 40 is retracted by hydraulic fluid in conventional fluid supply and return lines (not shown) so as to swing the inboard ends 42, 44 of levers 26, 28 away from one another and clear the rollers 56 from above the chuck sockets so that a drill steel 68 may be installed in the chuck socket. Thereafter ram 40 is actuated so as to swing the inboard ends 42, 44 of levers 26 and 28 together towards the axis of the drill steel so that rollers 46 embrace and bracket the drill steel. The pivotal supports at the corners of the chassis plates 50 permit the latter to swing so as to accommodate the rollers to the drill steel, even though the latter may be somewhat tipped to one side or the other, and if it is necessary to shift the boom-support for drill box 4 somewhat in order to drive the drill steel 68 in the desired direction, the pivotal mountings of the lower chassis plates 50 permit this to be done while the drill steel remains embraced by the rollers.

I claim:

1. A device for centering a drill steel for rotation about an axis of rotation of a chuck socket in a drill box, comprising, a mounting plate adapted to be secured to said drill box, a spaced pair of posts on the mounting plate, a pair of levers having corresponding ends disposed on opposite sides of said chuck socket axis, means mounting said levers respectively on said posts for swinging movement in opposite directions towards and away from said socket axis, a fluid actuated ram connected between said levers for effecting said swinging movement thereof, a pair of rollers chassis plates pivotally supported on said corresponding ends of said levers for swinging movement about other axes which are parallel to said chuck socket axis and respectively disposed on opposite sides of said chuck socket axis, and a spaced pair of rollers mounted on said chassis plates, said rollers being so disposed with respect to one another and the pivotal supports of said chassis plates as to bracket the said axis of rotation of the chuck socket.

2. The device claimed in claim 1, and adjustable means on one of said posts for limiting the extent of swinging movement of one of said levers in each of said opposite directions.

3. The device claimed in claim 1, said levers being of the first class, said ram being connected to ends of said levers opposite said corresponding ends.

4. The device claimed in claim 1, said roller chassis plates being triangular and each being pivotally supported at one corner thereof on one of said corresponding ends of a lever, each of said spaced pairs of rollers being mounted at the other corners of a chassis plate.

5. The device claimed in claim 1, the axis of rotation of the chuck socket, the axes of swinging movement of the levers, the axes of swinging movement of said roller chassis plates, and the axes of rotation of said rollers all being parallel to one another.

* * * * *